United States Patent [19]

Kida

[11] Patent Number: 4,535,691

[45] Date of Patent: Aug. 20, 1985

[54] GRIPPER OPENING/CLOSING APPARATUS OF SHEET-FED ROTARY PRESS

[75] Inventor: Kenji Kida, Ibaragi, Japan

[73] Assignee: Komori Printing, Tokyo, Japan

[21] Appl. No.: 650,319

[22] Filed: Sep. 12, 1984

[51] Int. Cl.[3] ..... B41F 5/02

[52] U.S. Cl. ..... 101/230; 101/246; 101/183; 74/568 R; 271/82; 271/277

[58] Field of Search ..... 101/230, 231, 229, 246, 101/409, 410, 183; 271/82, 277; 74/568 R, 568 T

[56] References Cited

U.S. PATENT DOCUMENTS

| | | | |
|---|---|---|---|
| 2,757,610 | 8/1956 | Gegenheimer et al. | 271/82 |
| 3,742,847 | 7/1973 | Zimmermann et al. | 101/230 |
| 3,772,990 | 11/1973 | Weisgerber | 101/230 |
| 3,796,154 | 3/1974 | Weisgerber | 101/230 X |
| 3,944,218 | 3/1976 | Cerny | 101/230 X |
| 4,014,261 | 3/1977 | Becker | 101/230 |
| 4,122,773 | 10/1978 | Wirz | 101/230 |
| 4,390,176 | 6/1983 | Kato | 271/277 X |

*Primary Examiner*—Clifford D. Crowder
*Attorney, Agent, or Firm*—Townsend and Townsend

[57] ABSTRACT

A gripper opening/closing apparatus in a sheet-fed rotary printing press, the apparatus having a broadside printing cam and a perfecting cam which are commonly brought into contact with cam followers, and which are adjacent to each other to be coaxial with an impression cylinder, and the apparatus being arranged such that, in a broadside printing mode, grippers of the impression cylinder are opened/closed by the broadside printing cam to cause reversing grippers of a reversing cylinder to grip a leading end of a printed sheet gripped by the grippers of the impression cylinder, and that, in a perfecting mode, the grippers of the impression cylinder is opened/closed by the perfecting cam and the broadside printing cam to cause the reversing grippers of the reversing cylinder to grip a trailing end of the printed sheet gripped by the grippers of the impression cylinder, wherein a central angle of the impression cylinder which is formed between a sheet gripping position where the grippers of the impression cylinder grip the sheet from a preceding stage and a transfer position where the sheet is transferred from the grippers of the impression cylinder to the reversing grippers of the reversing cylinder is set to be smaller than a remaining central angle of the impression cylinder, and wherein shapes of the broadside printing cam and the perfecting cam are determined in such a manner that, in the broadside printing mode, the perfecting cam is located in a portion of the impression cylinder which corresponds to the remaining central angle so as to set the perfecting cam away from a sheet release position of the broadside printing cam and to set the perfecting cam in an inactive state, and that, in the perfecting mode, the perfecting cam is located to be continuous with the sheet release position of the broadside printing cam.

6 Claims, 7 Drawing Figures

GRIPPER OPENING/CLOSING APPARATUS OF SHEET-FED ROTARY PRESS

BACKGROUND OF THE INVENTION

The present invention relates to a gripper opening/-closing apparatus in a sheet-fed rotary press with a reversing mechanism so as to perform perfecting and broadside printing.

Conventional sheet-fed printing presses are classified into perfecting presses and broadside printing presses in accordance with a sheet side to be printed. In order to decrease installation and printing costs caused by preparing two types of printing presses, a single sheet-fed rotary printing press for performing perfecting and broadside printing has been developed and is used in practice.

FIGS. 1 and 2 are side views of the two types of conventional printing presses, in which FIG. 1 shows an example of broadside printing and FIG. 2 shows an example of perfecting. Referring to each of FIGS. 1 and 2, first and second color printing units 1 and 2 have plate cylinders 3 and 4 mounted with plates, blanket cylinders 5 and 6 to which images of the plates are transferred, and impression cylinders 7 and 8 each having a diameter twice that of the plate cylinder or blanket cylinder. A reversing cylinder 9 having the same diameter as that of the impression cylinder 7 or 8 is disposed between the impression cylinders 7 and 8. A transfer cylinder 10 is disposed at the upstream side of the impression cylinder 7. The transfer cylinder 10 has the same diameter as that of the plate cylinder 3 or 4. A gripper unit 13 is also disposed in the vicinity of the transfer cylinder 10 to feed to the impression cylinder 7 sheets 12 fed to a feedboard 11 one by one.

Referring to FIG. 1, the sheet 12 fed to the feedboard 11 is fetched by grippers of the gripper unit 13 and is gripped by grippers of the transfer cylinder 10 rotating in a direction indicated by arrow A. The sheet 12 is then gripped by grippers 14 of the impression cylinder 7 and is wound around the impression cylinder 7 rotating in a direction indicated by arrow B. When the sheet 12 passes between the blanket cylinder 5 and the impression cylinder 7, an image is printed on a surface 12*a* of the sheet 12. The leading end of the sheet 12 is then transferred from the grippers 14 to reversing grippers 15 of the reversing cylinder 9. The sheet 12 wound around the surface of the reversing cylinder 9 by a distance substantially half the circumference of the cylinder 9 is transferred from the reversing grippers 15 of the reversing cylinder 9 to the grippers of the impression cylinder 8. The sheet 12 then passes between the blanket cylinder 6 and the impression cylinder 8, so that second-color printing is performed on the same surface 12*a* as in first-color printing, thereby performing broadside printing.

However, in the perfecting printing shown in FIG. 2, after the surface 12*a* of the sheet 12 is printed in the same manner as in FIG. 1, the sheet 12 is kept gripped by the grippers 14 and passes through the contact portion between the reversing cylinder 9 and the impression cylinder 7. The sheet 12 is then wound around the impression cylinder 7 in such a manner that the trailing end of the sheet 12 is gripped by the reversing grippers 15. At the same time, the leading end (to be the trailing end when the sheet 12 is wound around the reversing cylinder 9) is released from the grippers 14. The sheet 12 is wound around the reversing cylinder 9 while the surface 12*a* faces outward. The sheet 12 is then gripped by the grippers of the impression cylinder 8. The sheet 12 is wound around the impression cylinder 8 in such a manner that the surface 12*a* faces the impression cylinder 8. As a result, an image is printed on a surface 12*b* of the sheet 12.

In broadside printing and perfecting, the phases between the grippers 14 and the reversing grippers 15 differ from each other. In perfecting, the reversing gripper 15 itself must rotate through about 180° while being rotated along the periphery of the reversing cylinder 9. When broadside printing and perfecting are switched, phase adjustment between the reversing cylinder 9 and the impression cylinder 7 must be performed, and the position of an opening/closing reversing cam for the reversing grippers 15 must be switched. At the same time, the position of a cam for opening/-closing the grippers 14 of the impression cylinder 7 must be switched. More particularly, as shown in FIG. 1, the grippers 14 grip the sheet 12 and are rotated through an angle of less than 180°. However, in perfecting, the grippers 14 grip the sheet 12 and are rotated through an angle of more than 300°. Therefore, two cams overlap each other in broadside printing to constitute a cam 16, while the phases of these two cams differ from each other in perfecting to constitute a cam 17. In this case, when a gripper unit is disposed to oppose the impression cylinder 7 without providing the transfer cylinder 10, as indicated by a dotted line 13A, the position of the gripper unit 13 is raised due to the limit of the inclined angle of the feedboard 11. When a size of the sheet 12 is large, an angle $\theta 1$ becomes larger than an angle $\theta$ in FIG. 2. In this case, it is impossible to achieve satisfactory large-sized sheet printing by changing the phases of the two cams. In order to solve the problem, therefore, it is necessary to provide the transfer cylinder 10 and adopt a lower swing system in which the pivot shaft of the gripper unit 13 is arranged at the lower end thereof.

According to the conventional printing press of this type, the transfer cylinder 10 must be arranged to increase the number of gripping operations of the sheet once. The sheet cannot then be aligned with high precision, and the sheet tends to move irregularly, resulting in wrinkles. In addition to these disadvantages, the construction becomes complicated, and maintenance becomes time-consuming. Furthermore, since the lower swing system is adopted, a space below the feedboard 11 becomes narrowed, and maintenance of the impression cylinder 7 becomes cumbersome and time-consuming, resulting in inconvenience.

The two cam positions must be changed in accordance with the length of the sheet 12 to be printed when broadside printing is switched to perfecting. For example, in a printing press for medium octavo paper, the cam positions must be changed by a distance of 720 mm when a maximum sheet size is used. In this case, manual cam adjustment is cumbersome and time-consuming. When printing jobs are of great variety and of short run, changeovers from broadside printing to perfecting and vise versa must be carried out very frequently, so that this manual cam switching operation, which takes 3 to 5 minutes, is not desirable.

Recently, an apparatus has been developed wherein cams are automatically pivoted by a motor in accordance with a preset paper size. However, when a stroke of the cam movement is increased, the control precision is degraded. Because of this, the stroke must be minimized.

In the conventional apparatus, the reversing gripper opening/closing apparatus is provided in the first color printing unit. However, a transfer cylinder 9A may be disposed at a higher position than the illustrated position to arrange reversing grippers, or a notch in the impression cylinder 8 may be enlarged in the second or subsequent color printing unit. In this manner, the reversing gripper opening/closing apparatus can be disposed in the second or subsequent color printing unit in the same manner as in the first color printing unit 1. However, the same problem as described above is still presented.

SUMMARY OF THE INVENTION

It is an object of the present invention to provide a gripper opening/closing apparatus for a sheet-fed rotary printing press so as to improve utilization efficiency of the printing press and switching efficiency between broadside printing and perfecting.

In order to achieve the above object of the present invention, there is provided a gripper opening/closing apparatus in a sheet-fed rotary printing press, the apparatus having a broadside printing cam and a perfecting cam which are commonly brought into contact with cam followers, and which are adjacent to each other to be coaxial with an impression cylinder, and the apparatus being arranged such that, in a broadside printing mode, grippers of the impression cylinder are opened/closed by the broadside printing cam to cause reversing grippers of a reversing cylinder to grip a leading end of a printed sheet gripped by the grippers of the impression cylinder, and that, in a perfecting mode, the grippers of the impression cylinder are opened/closed by the perfecting cam and the broadside printing cam to cause the reversing grippers of the reversing cylinder to grip a trailing end of the printed sheet gripped by the grippers of the impression cylinder, wherein a central angle of the impression cylinder which is formed between a sheet gripping position where the grippers of the impression cylinder grip the sheet from a preceding stage and a transfer position where the sheet is transferred from the grippers of the impression cylinder to the reversing grippers of the reversing cylinder is set to be smaller than a remaining central angle of the impression cylinder, and wherein shapes of the broadside printing cam and the perfecting cam are determined in such a manner that, in the broadside printing mode, the perfecting cam is located in a portion of the impression cylinder which corresponds to the remaining central angle so as to set the perfecting cam away from a sheet release position of the broadside printing cam and to set the perfecting cam in an inactive state, and that, in the perfecting mode, the perfecting cam is located to be continuous with the sheet release position of the broadside printing cam.

BRIEF DESCRIPTION OF THE DRAWINGS

FIGS. 3 to 7 show a gripper opening/closing apparatus in a sheet-fed rotary printing press according to an embodiment of the present invention, in which FIG. 3 is a side view of the printing press for explaining broadside printing, FIG. 4 is a side view of the printing press for explaining perfecting, FIG. 5 is a front view of a cam mounting end of an impression cylinder of the printing press, FIG. 6 is a sectional view of the cam mounting end of the impression cylinder, and FIG. 7 is a sectional view of the cam mounting end along the line C—C of FIG. 6.

DETAILED DESCRIPTION OF THE PREFERRED EMBODIMENT

The present invention will be described in detail with reference to a preferred embodiment.

Figure 1:
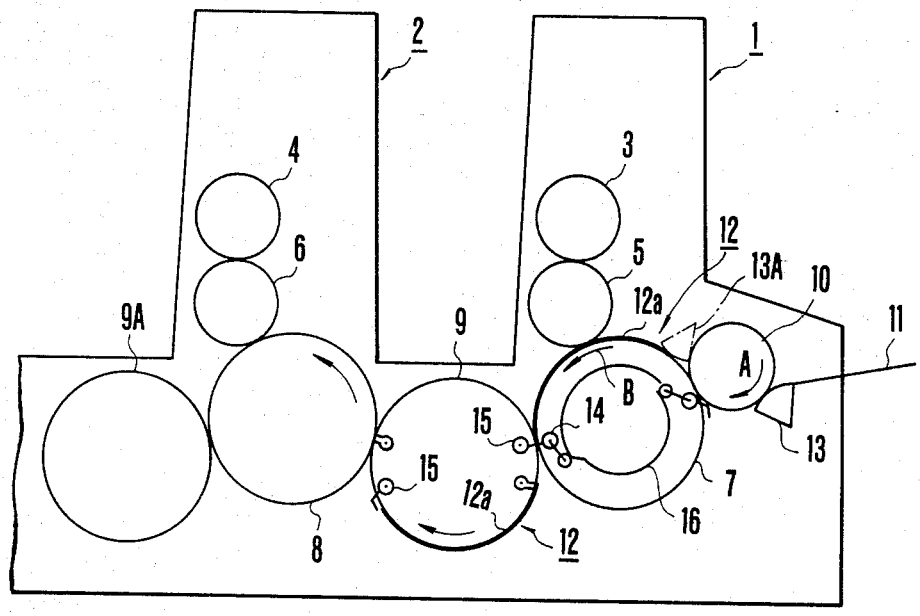
FIG. 1 PRIOR ART
FIG. 1 is an example of a conventional sheet-fed rotary printing press for both broadside printing and perfecting in the broadside printing mode.
Figure 2:
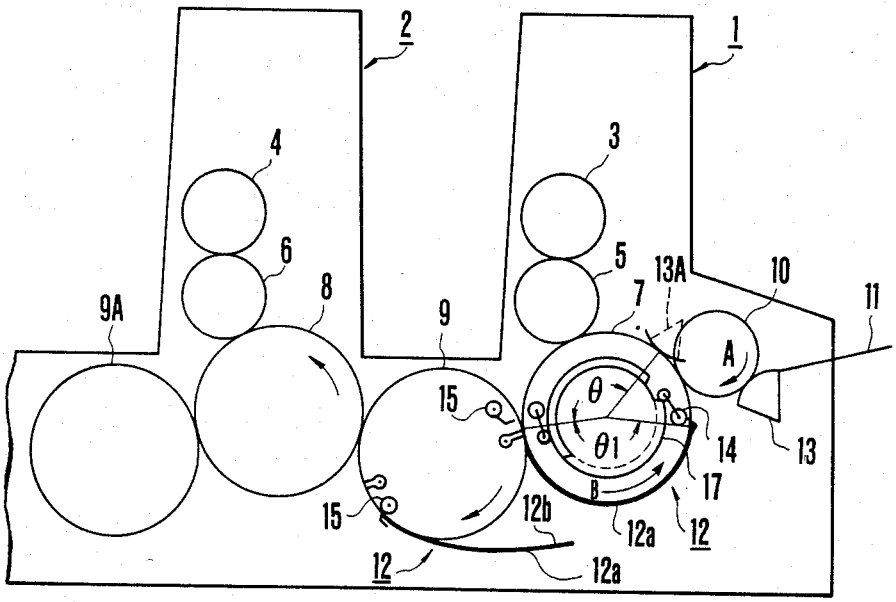
FIG. 2 PRIOR ART
FIG. 2 is the conventional sheet-fed rotary printing press in the perfecting mode.
Figure 3:
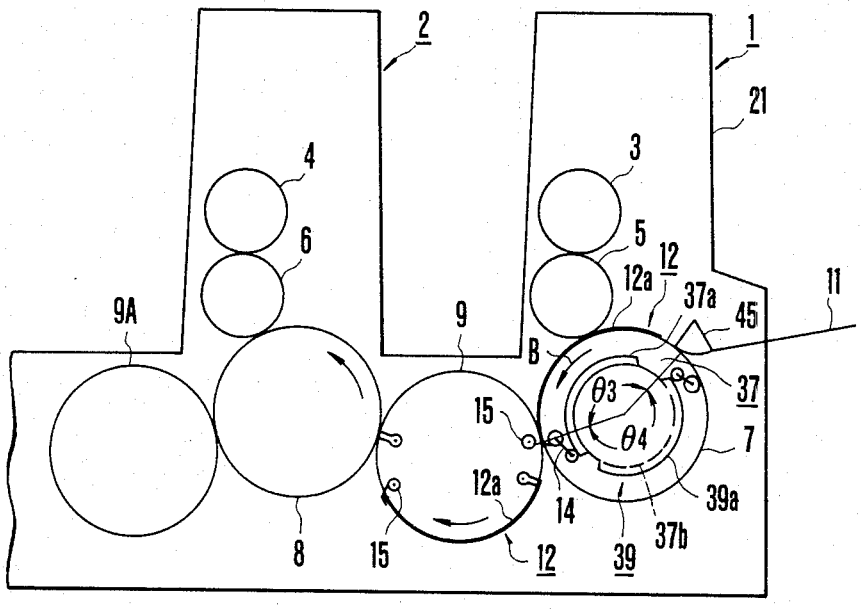
Figure 4:
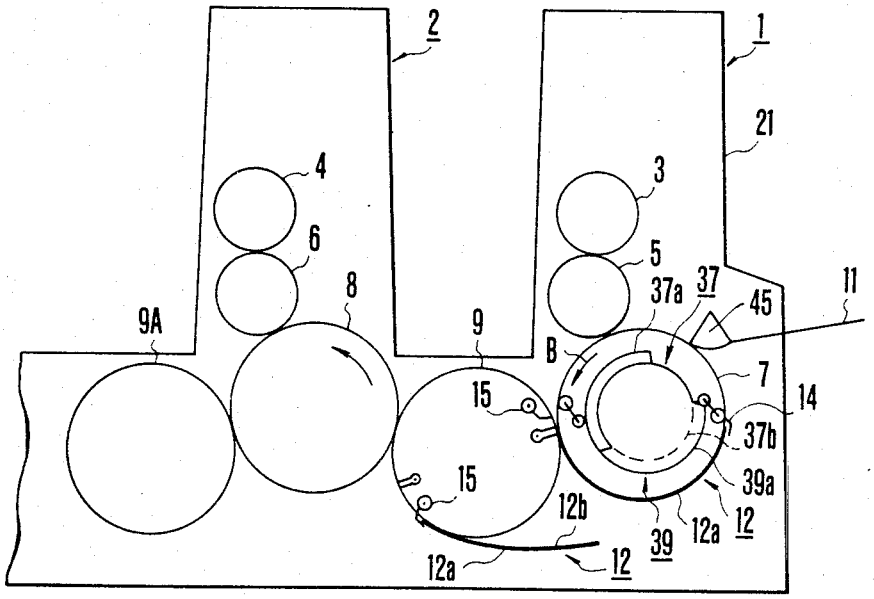
Figure 5:
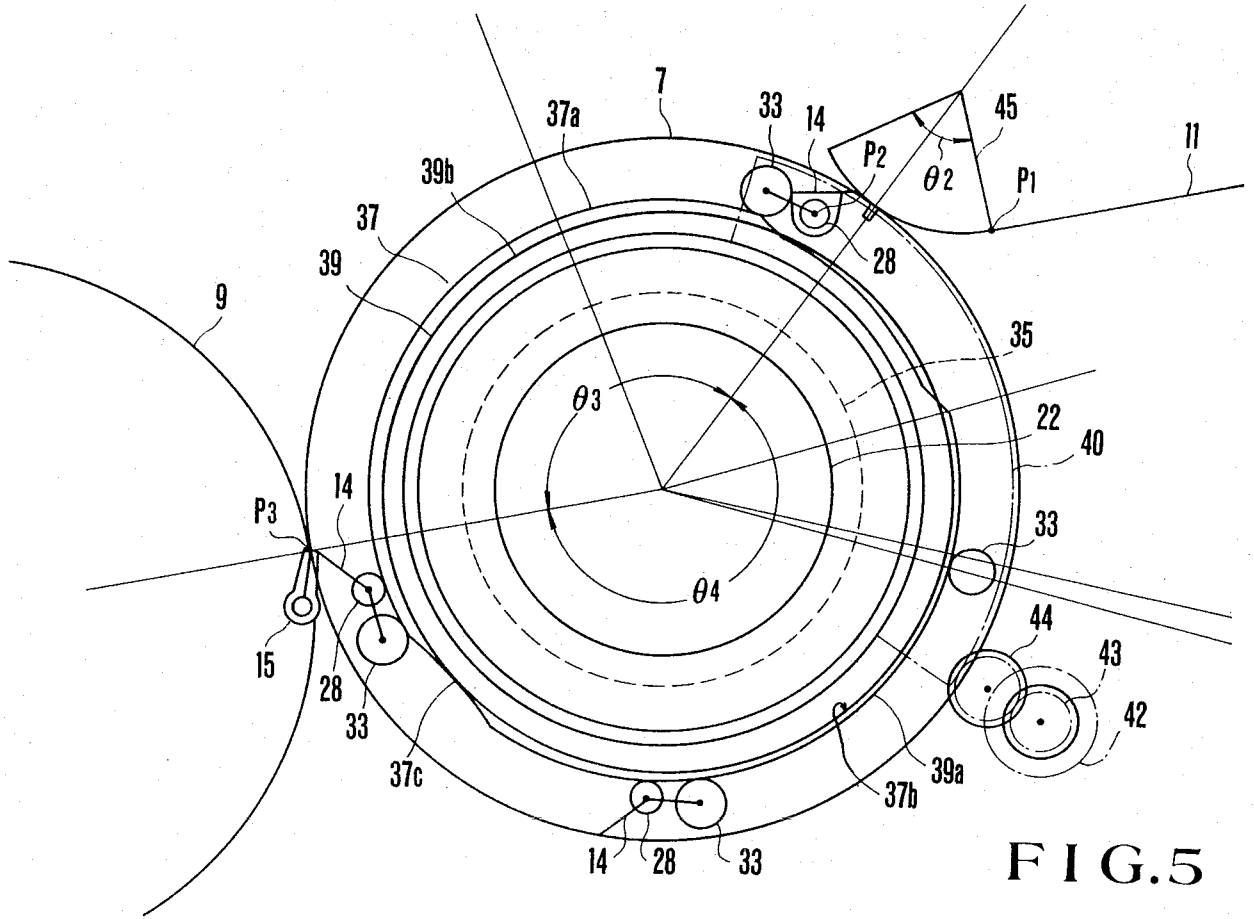
Figure 6:
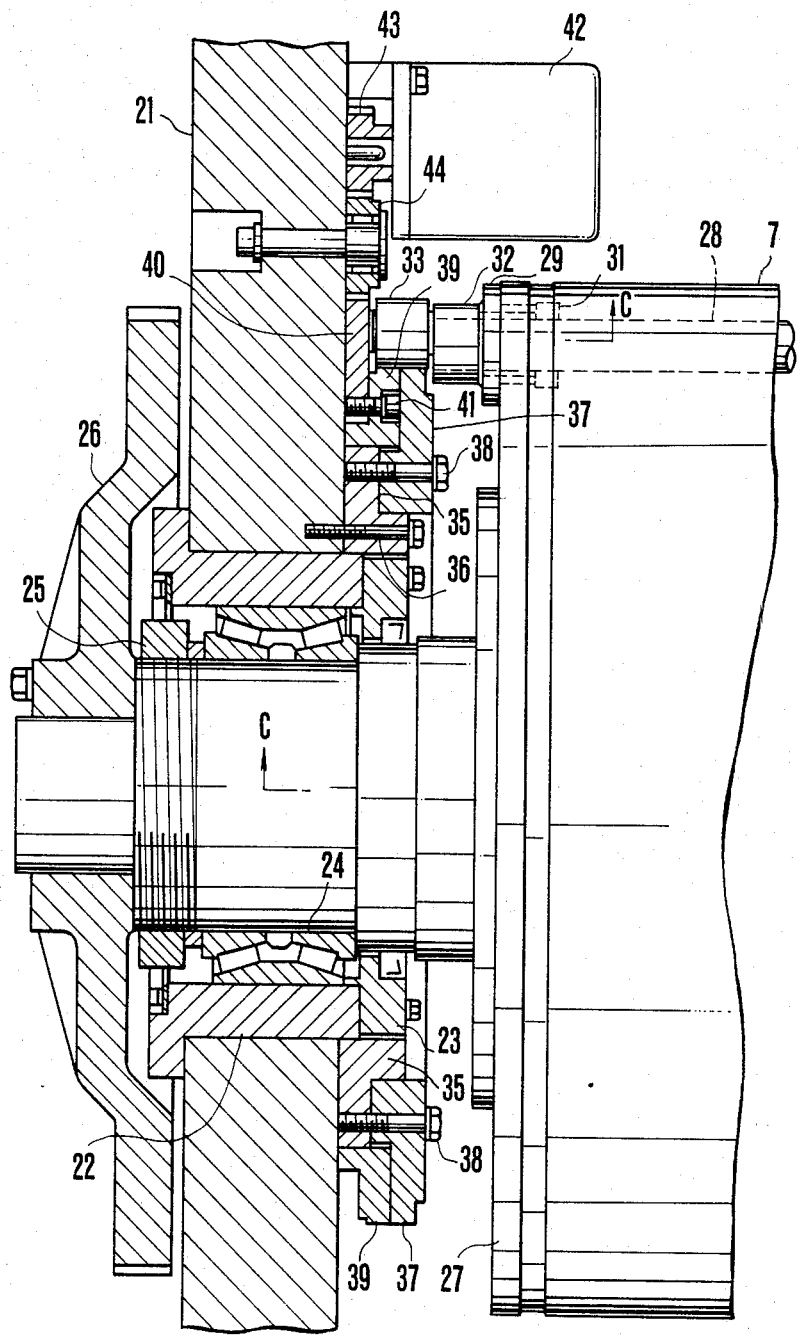
Figure 7:
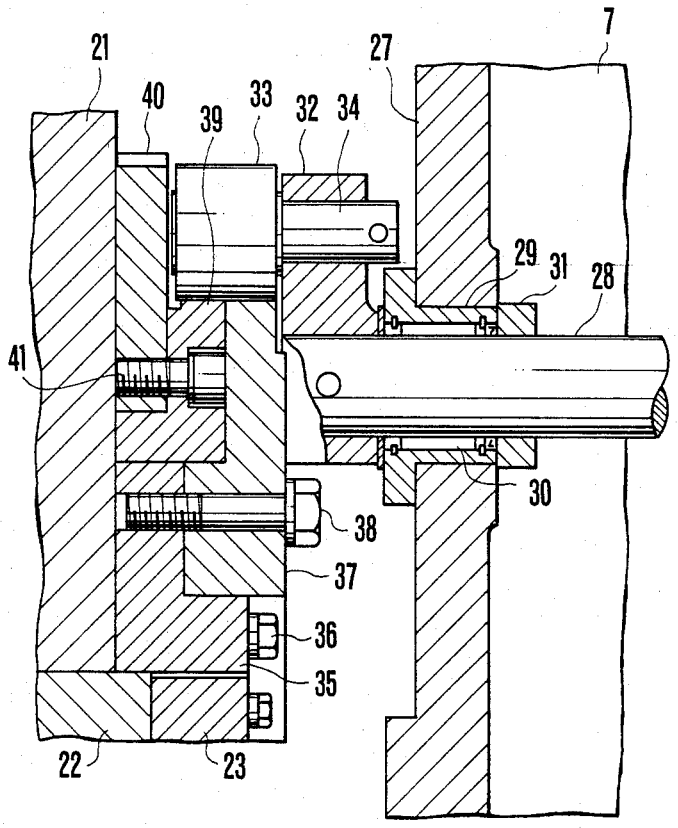

The present invention is applied to a single color printing unit in a sheet-fed rotary printing press. FIG. 3 shows the printing press when broadside printing is performed, and FIG. 4 shows the printing press when perfecting is performed. FIG. 5 is a front view of a cam mounting end of an impression cylinder of the printing press, FIG. 6 is a sectional view of the cam mounting end of the impression cylinder, and FIG. 7 is a sectional view of the cam mounting end along the line C—C of FIG. 6. The same reference numerals in FIGS. 3 to 7 denote the same parts as in FIGS. 1 and 2, and a detailed description thereof will be omitted.

Referring to FIGS. 3 to 7, a taper roller bearing 24 is fitted in a bearing bush 22 mounted in each of right and left frames 21 in the first color printing unit 1. The axial movement of the taper roller bearing 24 is defined by a cover 23. The shaft of the impression roller 7 is supported by the taper roller bearings 24. The axial movement of the impression cylinder 7 is limited by nuts 25 around threaded portions of the shaft of the cylinder 7 and step portions of the impression roller 7. When a gear 26 fixed at a corresponding end portion of the shaft of the impression cylinder 7 meshes with a gear at the driving side, the driving force is transmitted from the driving side to the impression cylinder 7. Recesses, each having a triangular section, are formed in portions which bisect the circumferential surface of the impression cylinder 7. All ends of the triangular recesses are closed by disc-shaped bearers 27 integrally formed with the two ends of the impression cylinder 7, respectively. Gripper shafts 28 are disposed in the two recesses and are pivotally supported by needle bearings 30 in bearing bushes 29 mounted in the bearers 27, respectively. The axial movement of the gripper shafts 28 is limited by their respective collars 31. A plurality of grippers are aligned on each gripper shaft 28. Levers 32 are fixed on the two ends of each gripper shaft 28. Cam followers 33 having a large width are pivoted by pins 34 at free ends of the levers 32, respectively.

Cam supports 35 concentric with the impression cylinder 7 are fixed by bolts 36 on the inner surfaces of the right and left frames 21, respectively. An annular broadside printing cam 37 to be described in detail later, is mounted by means of bolts 38 (shown in FIG. 6) on a step portion of the support 35 in such a manner that the cam followers 33 are in rolling contact with the circumferential surface of the cam 37. An annular perfecting cam 39 is pivotally fitted with the circumferential surface of the cam support 35 by means of bolt 41 (in FIG. 6) and is brought into rolling contact with the cam followers 33. A sector-shaped adjusting gear 40 is fitted in the step portion of the corresponding frame 21 and is fixed integrally with the annular perfecting cam 39 with bolts 41. Reference numeral 42 denotes a low-speed adjusting motor fixed on the frame 21. A gear 43 mounted on the motor shaft is meshed with the adjusting gear 40 through an intermediate gear 44 mounted on the frame 21. When the motor 42 is rotated, the adjusting gear 40 is rotated to rotate the perfecting cam 39, so that phase adjustment between the perfecting cam 39 and the broadside printing cam 37 is performed since the broadside printing cam 37 is fixed on the frame 21.

Reference numeral 45 denotes a gripper unit which has an upper swing shaft and which swings in a range of an angle $\theta 2$, as shown in FIG. 5. The grippers at the swing end of the gripper unit 45 grip the leading end of the sheet 12 on the feedboard 11 and carry the sheet from a point P1 to a point P2 in FIG. 5. The sheet 12 is then gripped by the grippers 14 of the impression cylinder 7 at the point P2.

The positional relationship between the broadside printing cam 37, the perfecting cam 39, and the gripper unit 45 will be described in detail. Each of the cams 37 and 39 has large- and small-diameter portions. The cam followers 33 are biased by springs (not shown) to be in rolling contact with the large- and small-diameter portions of the cams 37 and 39. When a given cam follower 33 is brought into rolling contact with the large-diameter portion, the corresponding grippers 14 are closed. However, when the given cam follower 33 is brought into rolling contact with the small-diameter portion, the corresponding grippers 14 are opened by the biasing force of the corresponding spring.

The broadside cam 37 has a large-diameter portion 37*a* and a small-diameter portion 37*b* and is fixed on the frame 21 through the cam support 35, as described above. When a given cam follower 33 is brought into rolling contact with a front end of the large diameter portion 37*a*, the distal end of the corresponding grippers 14 are located at the point P2 as a sheet gripping point. When the given cam follower 33 is brought into rolling contact with the rear end of the large-diameter portion 37*a*, the distal end of the corresponding gripper 14 is located at the point P3 as a sheet release position. The gripper unit 45 is limited by an operating angle thereof and an inclined angle of the feedboard 11. An inscribed angle $\theta 3$ that the sheet gripping point P2 of the gripper 14 and the sheet release point P3 subtends at the center of the impression cylinder 7 is smaller than a remaining inscribed angle $\theta 4$ of the impression cylinder 7. The large-diameter portion 37*a* of the broadside printing cam 37 corresponds to the central angle $\theta 3$.

The perfecting cam 39 has a large-diameter portion 39*a* and a small-diameter portion 39*b* and is arranged such that a phase thereof can be adjusted with respect to the broadside printing cam 37. The large-diameter portion 39*a* is formed to have an angle such that it is spaced apart from the large-diameter portion 37*a* of the broadside printing cam 37 when the large-diameter portion 39*a* is located at a portion corresponding to the larger central angle $\theta 4$, as shown in FIG. 3, and which also enables printing of a maximum-sized sheet when the large-diameter portions 37*a* and 39*a* become continuous, as shown in FIG. 4.

The gripper opening/closing apparatus having the above construction will be described. In broadside printing, as shown in FIGS. 3 and 5, the cam 39 is located at a side of the impression cylinder 7 which corresponds to the larger angle $\theta 4$. A small valley portion 37*c* smaller than the small diameter portion 37*b* is formed between the large-diameter portions 37*a* and 39*a* of the cams 37 and 39 so as to open given grippers 14. The perfecting cam 39 is located outside the range of gripping of the sheet 12 by means of the grippers 14. In other words, the perfecting cam 39 is located in the inactive state. In this state, when the printing press is operated, the sheets 12 fed one by one to the feedboard 11 are individually fed by the grippers of the gripper unit 45. A given sheet 12 is then transferred from the grippers of the gripping unit 45 to the given grippers 14 at the point P2. Upon rotation of the impression cylinder 7, the image is printed on the surface 12*a* of the sheet 12. When the given grippers 14 have reached the point P3, the leading end of the sheet 12 is gripped by the corresponding inverting grippers 15, so that a second image is thus printed on the same surface 12*a*, thereby achieving broadside printing. In this case, when a given cam follower 33 passes the point P3 and is brought into rolling contact with the valley portion 37*c*, the corresponding grippers 14 are fully opened. In addition, the given cam follower is brought into rolling contact with the large-diameter portion 39*a* of the perfecting cam 39 so that the corresponding grippers 14 are closed.

In order to switch from broadside printing to perfecting, the adjusting motor 42 is rotated in a predetermined direction. The perfecting cam 39 is rotated clockwise via the intermediate gear 44 and the sector-shaped adjusting gear 40. As shown in FIG. 4, the large-diameter portions 37*a* and 39*a* of the cams 37 and 39 become continuous or overlapped. The pivot angle of the cam 39 is controlled by a potentiometer or the like provided in the adjusting motor 42. When the sheet 12 has a small size, the overlap portion between the cams 37 and 39 is increased. However, when the sheet 12 has a larger size, the overlap portion is decreased in accordance with the given size. Since the angle of the large-diameter portion 39*a* has a length corresponding to the maximum sheet size, even if a sheet having the maximum size is used, sheet releasing of the gripper 14 can be guaranteed. When the printing press is operated in this state, the gripper 14 gripping the leading end of the sheet 12 at the point P2 is kept closed since the large-diameter portions 37*a* and 39*a* are continuous. The sheet 12 is rotated until the trailing end reaches the point P3. In the position shown in FIG. 4, the trailing end of the sheet 12 is gripped by the corresponding reversing gripper 15 of the reversing cylinder 9. At the same time, the corresponding cam follower 33 descends along the downward slope of the large-diameter portion 39*a*, so that the leading end of the sheet 12 is released. Thereafter, the surface 12*b* of the sheet 12 is in contact with the outer surface of the reversing cylinder 9, and the sheet 12 is gripped by the grippers of the impression cylinder 8, so that a second image is printed on the surface 12*b* of the sheet 12, thereby completing the perfecting printing operation.

Even if the angle $\theta$ is made small through the adoption of the upper swing type gripper unit 45, a proper gripping operation can be performed is in either mode. In broadside printing, the perfecting cam 39 is located in the portion of the impression cylinder 7 which corresponds to the large central angle $\theta 4$ thereof, and the perfecting cam 39 is set in the inactive state. However, in perfecting, the large-diameter portions 37*a* and 39*a* become continuous. In this manner, irrespective of the printing mode, the sheet gripping operation can be properly performed. When the mode is switched to the perfecting mode, an angular displacement of the perfecting cam 39 under the condition that an angular interval of 180 mm is required to permit a smooth upward-movement of the cam follower along the valley portion of the sheet 12 is released to the reversing cylinder 9 in the broadside printing mode is given as follows. For example, an angular displacement is 180 mm, when a sheet having a maximum length of 720 mm is used. When a sheet having a minimum length of 360 mm is used, an angular displacement of the cam 39 becomes 540 mm (=(720 mm−360 mm)+180 mm). In practice, such a short sheet is rarely used. A longer paper sheet having a length of 650 to 720 mm is frequently used. According to a conventional printing press, the perfecting cam is pivoted by an angular interval of 650 to 720 mm. However, according to the printing press of the present invention, only an angular interval of 180 to 250 mm is required. Therefore, the angular displacement can be decreased to about $\frac{1}{3}$ that of the conventional case.

In the above embodiment, the present invention is applied to the first color printing unit. However, when a transfer cylinder 9A is moved upward, or the notches of the impression cylinder 9 are increased, the gripper opening/closing mechanism can also be provided in the same manner as in the first color printing unit. In this case, the angular displacement of the cam 39 can be decreased to about $\frac{1}{3}$ that of the conventional case, irrespective of the printing mode.

As is apparent from the above description, in the gripper opening/closing apparatus in the sheet-fed rotary printing press according to the present invention, the fixed broadside printing cam is arranged such that the central angle formed between the sheet gripping position of the grippers of the impression cylinder and the sheet release position (i.e., transfer position from the grippers of the impression cylinder to the grippers of the reversing cylinder) of the grippers thereof is set to be smaller than the remaining central angle of the impression cylinder. At the same time, the phase-variable perfecting cam is arranged in the vicinity of the fixed broadside printing cam. In broadside printing, the perfecting cam is located at a portion of the impression cylinder which corresponds to the larger central angle. In this manner, the perfecting cam is set in the inactive state. However, in perfecting, the large-diameter portions of the broadside printing cam and the perfecting cam become continuous. Therefore, a stroke of the perfecting cam is greatly decreased to about $\frac{1}{3}$ that of the conventional cam adjusting mechanism. Therefore, the switching time between broadside printing and perfecting can be greatly decreased, and the necessary labor is decreased so improving the utilization efficiency of the printing press. When the cam is pivoted by a motor or the like, the positional precision can be improved since the stroke of the cam is decreased to about $\frac{1}{3}$ that of the conventional case.

What is claimed is:

1. A gripper opening/closing apparatus in a sheet-fed rotary printing press, said apparatus having a broadside printing cam and a perfecting cam which are commonly brought into contact with cam followers, and which are adjacent to each other to be coaxial with an impression cylinder, and said apparatus being arranged such that, in a broadside printing mode, grippers of said impression cylinder are opened/closed by said broadside printing cam to cause a reversing gripper of a reversing cylinder to grip a leading end of a printed sheet gripped by said grippers of said impression cylinder, and that, in a perfecting mode, said grippers of said impression cylinder are opened/closed by said perfecting cam and said broadside printing cam to cause said reversing grippers of said reversing cylinder to grip a trailing end of the printed sheet gripped by said grippers of said impression cylinder, wherein a central angle of said impression cylinder which is formed between a sheet gripping position where said grippers of said impression cylinder grip the sheet from a preceding stage and a transfer position where the sheet is transferred from said gripper of said impression cylinder to said reversing grippers of said reversing cylinder are set to be smaller than a remaining central angle of said impression cylinder, and wherein shapes of said broadside printing cam and said perfecting cam are determined in such a manner that, in the broadside printing mode, said perfecting cam is located in a portion of said impression cylinder which corresponds to the remaining central angle so as to set said perfecting cam away from a sheet release position of said broadside printing cam and to set said perfecting cam in an inactive state, and that, in the perfecting mode, said perfecting cam is located to be continuous with the sheet release position of said broadside printing cam.

2. An apparatus according to claim 1, further comprising a sector-shaped adjusting gear rotated together with said perfecting cam so as to change a phase with respect to that of said broadside printing cam fixed on a frame of said sheet-fed rotary printing press.

3. An apparatus according to claim 1, wherein said broadside printing cam comprises a first large-diameter portion and a second small-diameter portion, a distal end of each of said grippers of said impression cylinder being located in the sheet gripping position when a given one of said cam followers is located at a front end of said first large-diameter portion, and the distal end of each of said grippers of said impression cylinder being located in said sheet release position when the given one of said cam followers is located at a rear end of said first large-diameter portion.

4. An apparatus according to claim 3, wherein said first large-diameter portion has an angular interval substantially corresponding to the central angle.

5. An apparatus according to claim 4, wherein said perfecting cam comprises a second large-diameter portion and a second small-diameter portion, said first large-diameter portion having an angular interval which forms a satisfactory angle between said first and second large-diameter portions when said second large-diameter portion is located in the portion corresponding to the remaining central angle, and which forms an angle satisfactory for a sheet having a maximum length when said first and second large-diameter portions are continuous.

6. An apparatus according to claim 5, wherein said grippers of said impression cylinder are closed when a given one of said cam followers is brought into contact with one of said first and second large-diameter portions, and said grippers are opened when the given one of said cam followers is brought into contact with one of said first and second small-diameter portions.

* * * * *